US005647585A

United States Patent [19]

Cheong

[11] Patent Number: 5,647,585

[45] Date of Patent: Jul. 15, 1997

[54] PAPER CASSETTE

[75] Inventor: Sang-Won Cheong, Seoul, Rep. of Korea

[73] Assignee: SamSung Electronics Co., Ltd., Suwon, Rep. of Korea

[21] Appl. No.: 488,951

[22] Filed: Jun. 9, 1995

[30] Foreign Application Priority Data

Jun. 24, 1994 [KR] Rep. of Korea ..... 14658/1994

[51] Int. Cl.[6] ..... B65H 1/00

[52] U.S. Cl. ..... 271/171

[58] Field of Search ..... 271/171

[56] References Cited

U.S. PATENT DOCUMENTS

| | | | |
|---|---|---|---|
| 1,221,831 | 4/1917 | Burt | 271/171 |
| 2,444,580 | 7/1948 | Pratt et al. | 271/171 |
| 3,807,725 | 4/1974 | Bookless | 271/171 |
| 5,188,351 | 2/1993 | Gysling | 271/171 |

FOREIGN PATENT DOCUMENTS

| | | | |
|---|---|---|---|
| 0185730 | 8/1988 | Japan | 271/171 |
| 0276728 | 11/1990 | Japan | 271/171 |

*Primary Examiner*—H. Grant Skaggs
*Attorney, Agent, or Firm*—Robert E. Bushnell, Esq.

[57] ABSTRACT

A novel paper cassette installed in an electrophotographic recording system for accommodating papers of different sizes includes a cassette body for containing papers of different sizes to be fed into the image recording system, said cassette body having a paper size display panel comprising a plurality of characters and symbols affixed on an exterior of a front wall to provide a visual display of different sizes of papers being fed into the image recording system, and a slit formed on the front wall extending in a width direction perpendicular to said paper feed direction; a width regulation plate movably installed in the cassette body for regulating placement of papers of different widths in the width direction perpendicular to said paper feed direction; a length regulation plate movably installed in the cassette body for regulating placement of papers of different lengths in the paper feed direction; and an indicator integrally extended from the width regulation plate through the slit formed on the front wall of the cassette body, for indicating the size of papers being fed into the image recording system via the paper size display panel when the width regulation plate and the length regulation plate regulate the papers of different widths and lengths, respectively.

4 Claims, 4 Drawing Sheets

PAPER CASSETTE

CROSS-REFERENCE TO RELATED APPLICATIONS

This application makes references to, incorporates the same herein, and claims all benefits incurring under 35 USC §119 from an application for Paper Cassette earlier filed in the Korean Industrial Property Office on 24 Jun. 1994 and assigned Ser. No. 14658/1994.

BACKGROUND OF THE INVENTION

1. Technical Field

The present invention relates to a paper cassette to be loaded in an image recording system, such as a copier, facsimile, printer or the like. More specifically, the present invention relates to a so-called universal type of paper cassette simple in construction and capable of storing papers of different sizes and selectively feeding the stored papers into the image recording system.

2. Background Art

Generally, there are two types of paper cassettes used in an image recording system capable of recording papers of different sizes. The traditional type of paper cassette is capable of storing and feeding papers of a predetermined size. Consequently, if the image recording system were to record papers of different sizes, a plurality of paper cassettes, each being used for one paper size, is required so that papers can be fed selectively. However, the image recording system in which papers with multiple sizes are fed requires a corresponding plurality of paper feeders and becomes complicated, costly and large in size. In order to avoid these problems, a modem type of paper cassette referred to as a so-called universal paper cassette has been introduced, and is capable of storing and selectively feeding papers of different sizes, e.g., A4 size, letter size and legal size etc.

Typically, the universal paper cassette has a cassette body capable of containing papers of the largest size, and a pair of position regulation members movably installed in the cassette body to accommodate papers of different sizes. For example, in U.S. Pat. No. 4,343,461 for Paper Feeding Cassette issued to Tomimori et at., and U.S. Pat. No. 5,297,787 for Sheet Cassette issued to Shirai, the universal paper cassette includes a bottom plate movable in the paper-feeding direction to accommodate papers of different lengths and a single or a pair of side plates movable in the direction perpendicular to the paper-feeding direction so as to accommodate papers of different widths. The side plates could be adjusted as shown in U.S. Pat. No. 4,907,792 for Sheet Guide Adjusting Apparatus issued to Washiashi et al., Japanese Utility Model Publication No. 6-64759 for Paper Feed Guide Device For Document Or The Like issued to Kiuchi, Japanese Utility Model Publication No. 2-100930 for Universal Blank Form Cassette issued to Sakamoto by a gear mechanism i.e., a cam member comprised of a pinion and a cam follower for enabling the side plates to move in a reciprocal manner to accommodate papers of different widths in the cassette.

Alternatively, the single side plate could be adjusted in conjunction with the bottom plate by a gear mechanism to accommodate papers of different widths and lengths as shown in U.S. Pat. No. 4,786,042 for Adjustable Size Sensing Sheet Cassette issued to Stemmle and Japanese Utility Model Publication No. 3-166129 for Universal Cassette issued to Ito. The bottom plate could be adjusted manually either by a single lever as disclosed in Japanese Utility Model Publication No. 63-185730 for Paper Feeding Cassette issued to Yoshida, or alternatively by a plurality of paper discriminating levers as disclosed in Japanese Utility Model Publication No. 6-24586 and No. 6-32489 for Universal Paper Feeding Cassette issued to Ui. Ordinarily, these conventional paper cassettes however do not provide simple visual display of different sizes of papers stored in the cassette body to be fed into the image recording system when the paper cassettes are loaded into the image recording system.

Other universal paper cassettes such as those shown in U.S. Pat. No. 5,333,852 for Auto Paper Size Sensing Mechanism For An Adjustable Cassette issued to Milillo et al. are more sophisticated in that an automatic paper size sensing mechanism including an actuator arm attached to side plates having a plurality of switch actuators for selectively actuating a plurality of switches on the main body which respectively represent different paper sizes so as to allow a controller to interpret the length or width dimension of the paper in the cassette. Consequently, while Milillo '852 provides a visual display of papers of different sizes, he does so electronically.

U.S. Pat. No. 4,697,803 for Sheet Member Feeding Cassette issued to Kan et al., on the other hand, discloses an indicator panel comprising a plurality of characters and symbols formed on a side wall of a cassette to provide a visual display of the different size paper in the cassette via a window. Similarly, Japanese Utility Model Publication No. 57-131642 for Paper Supply Device issued to Hayakawa also provides a paper size display portion formed on a cassette body along with a lever connected to paper holders via a slider for enabling a user to adjust the paper holders to accommodate papers of different sizes manually. However, the internal working mechanism of Kan '803 and Hayakawa '642 is relatively complicated.

SUMMARY OF THE INVENTION

It is therefore an object of the present invention to provide a paper cassette having a simplified construction, so that the size of the paper to be fed into an electrophotographic recording system can be identified when the paper cassette is installed in the system.

It is another object of the present invention to provide a paper cassette capable of easily and correctly identifying the size of paper without requiring the user to inconveniently perform a setting operation of the size of paper.

To achieve these and other objectives, a novel paper cassette according to one embodiment of the present invention includes a cassette body for holding papers of different sizes to be fed into an electrophotographic recording system in a paper feed direction, and having a paper size display panel comprising a plurality of characters and symbols affixed on an exterior of a front wall to provide a visual display of different sizes of papers being fed into the system, and a slit formed on the front wall extending in a width direction perpendicular to the paper feed direction; a first guide member movably installed in the cassette body to accommodate papers of different widths, for regulating placement of the papers in the width direction perpendicular to the paper feed direction; and an indicator integrally connected to the first guide member extending through the slit formed on the front wall of the cassette body, for moving along the slit to indicate the size of papers being fed into the system via the paper size display panel when the first guide member accommodates the papers of different sizes.

According to another embodiment of the present invention, a novel paper cassette includes a cassette body for containing papers of different sizes to be fed into an electrophotographic recording system in a paper feed direction, and having a paper size display panel comprising a plurality of characters and symbols affixed on an exterior of a front wall to provide a visual display of different sizes of papers being fed into the system, and a slit formed on the front wall extending in a width direction perpendicular to the paper feed direction; a first guide member movably installed in the cassette body for regulating placement of papers of different widths in the width direction perpendicular to the paper feed direction; a second guide member movably installed in the cassette body for regulating placement of papers of different lengths in the paper feed direction; and an indicator integrally extended from the first guide member through the slit formed on the front wall of the cassette body, for indicating the size of papers being fed into the image recording system via the paper size display panel when the first guide member and the second guide member regulate the papers of different widths and lengths, respectively.

According to yet another embodiment of the present invention, a novel paper cassette includes a cassette body for containing papers of different sizes to be fed into an electrophotographic recording system in a paper feed direction, and having a paper size display panel comprising a plurality of characters and symbols affixed on an exterior of a front wall to provide a visual display of different sizes of papers being fed into the system, and a slit formed on the front wall extending in a width direction perpendicular to said paper feed direction; first and second guide members movably installed in the cassette body in the direction perpendicular to each other; and an indicator integrally extended from the first guide member through the slit formed on the front wall of the cassette body, for indicating the size of papers being fed into the system via the paper size display panel when the first guide member accommodates the papers of different widths, wherein the indicator has a first distal end connected to the first guide member, a second distal end extended through the slit, and a center portion mounted on a bottom portion of the cassette body for enabling the first end and the second end of the indicator to rotate in a reciprocal manner.

According to a yet another embodiment of the present invention, a novel paper cassette includes a cassette body for containing papers of different sizes to be fed into an electrophotographic recording system in a paper feed direction, and having a paper size display panel comprising a plurality of characters and symbols affixed on an exterior of a front wall to provide a visual display of different sizes of papers being fed into the image recording system, and a slit formed on the front wall extending in a width direction perpendicular to said paper feed direction; a first guide member movably installed in the cassette body for regulating placement of papers of different widths in the width direction perpendicular to the paper feed direction, and comprised of an integrally first rack gear enabling the first guide member to move in the width direction; a second guide member movably installed in the cassette body for regulating placement of papers of different lengths in the paper feed direction; an indicator formed in a T-shape with a distal end integrally extended through the slit formed on the front wall of the cassette body for indicating the size of papers to be fed into the image recording system via the paper size display panel, and comprised of an integrally second rack gear enabling the indicator to move in the paper feed direction; and a drive mechanism operatively engaged with the first rack gear and the second rack gear, for enabling the indicator to move in the width direction in a reciprocal manner with respect to said first guide member.

Finally, a novel paper cassette according to a further embodiment of the present invention includes a cassette body for containing papers of different sizes to be fed into an image recording system, and having a paper size display panel affixed on an exterior of a front wall to provide a visual display of different sizes of papers being fed into the image recording system, a slit formed on the front wall extending in a width direction perpendicular to a paper feed direction, and a second slit integrally formed on a distal end of the first slit extending vertically from the first slit; a first guide member movably installed in the cassette body for regulating placement of papers of different widths in the width direction perpendicular to the paper feed direction; a second guide member movably installed in the cassette body for regulating placement of papers of different lengths in the paper feed direction; an indicator integrally extended from the first guide member through the first slit formed on the front wall of the cassette body, for indicating the size of papers being fed into the image recording system via the paper size display panel when the first and second guide members accommodate the papers of different widths and lengths, respectively; a hinge fixed to an interior of a side wall of the cassette body; a first lever coupled to the hinge and integrally connected to the second guide member for enabling regulation of papers of different lengths in the paper feed direction; a second lever coupled to the hinge and integrally connected to the indicator for enabling the indicator to control regulation of said papers of different lengths in the paper feed direction when the indicator extending through the first slit moves vertically in an upward and downward direction through the second slit.

The present invention is more specifically described in the following paragraphs by reference to the drawings attached only by way of example.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
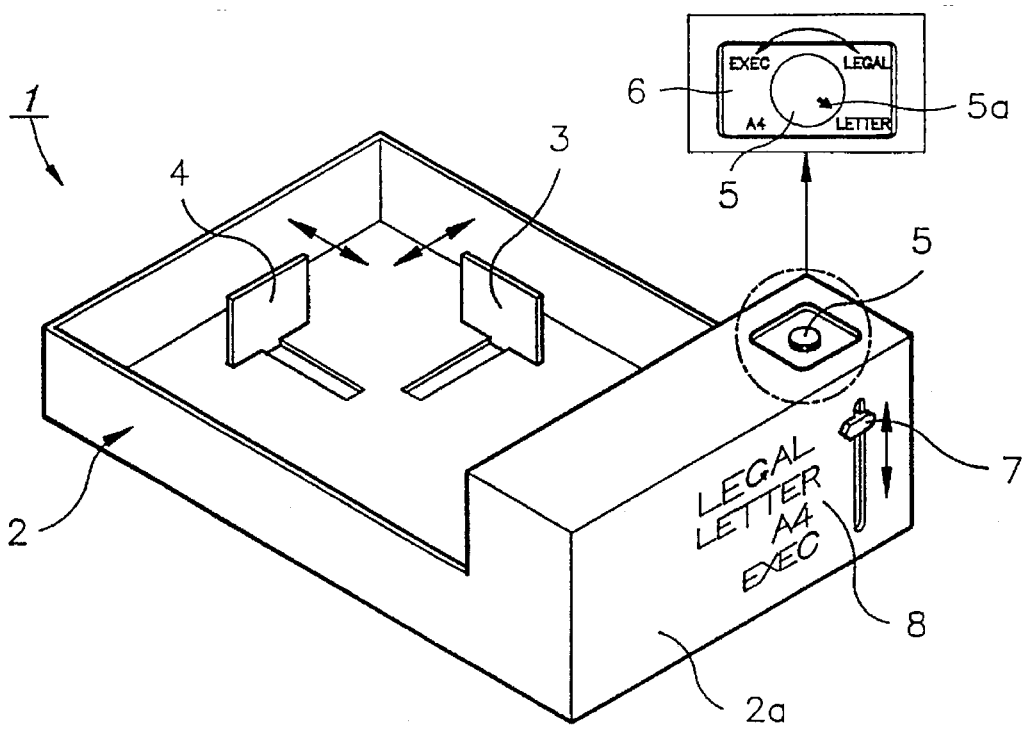
FIG. 1 is a schematic perspective view illustrating a conventional paper cassette.

Referring now to FIG. 1, a conventional universal type of paper cassette such as, for example, an option cassette (for use of 500 sheets) in "LASERJET4" of Hewlett Packard Corp., to be loaded into an electrophotographic recording system such as, for example, a laser printer includes a cassette body 2 for storing papers of different sizes, a pair of guide members 3 and 4 for guiding the paper into position irrespective of the size of paper loaded in the cassette body 2 and movably installed in a direction perpendicular to each other so as to firmly hold the paper in position, thereby enabling selective feeding of paper of different sizes into the electrophotographic recording system. The cassette body 2 is shaped in a rectangular box so as to accommodate paper of different sizes, for example, A4 size, letter size, legal size and executive size, and has sufficient height to accommodate as many papers therein.

In the conventional paper cassette such as one for the "LASERJET4," in order for a user to identify the size of paper loaded in the paper cassette 1 when the paper cassette 1 is installed in the electrophotographic recording system, a rotating knob 5 and an indicator 7 are separately and independently provided. Rotating knob 5 is arranged on a top portion of the cassette body 2 and includes an arrow 5*a* for indicating the various sizes of paper specified by a display penal 6 affixed on the top portion of the cassette body 2. Indicator 7 is formed on an exterior of a front wall of the cassette body 2 and is capable being adjusted manually by the user to move upward and downward according to the rotation of the rotating knob 5. When the knob 5 rotates and the arrow 5*a* shows the size of paper loaded in the cassette body 2, the indicator 7 indicates the exact size from a paper size display panel 8 representing a plurality of paper sizes affixed on an exterior of the front wall 2*a* of the cassette body 2, so that the user can identify the size of paper loaded in the paper cassette 1 from the exterior of the system even when the paper cassette 1 is installed in the electrophotographic recording system.

However, for the user to identify the size of paper loaded in the paper cassette 1 when the paper cassette 1 is installed in the electrophotographic recording system, the user must first move the guide members 3 and 4 to accommodate papers of different sizes loaded in the cassette body 2 and then separately and independently rotate the rotating knob 5 to adjust the position of the indicator 7 so as to accurately reflect the exact size of paper loaded in the cassette body. Consequently, it can be appreciated that the conventional approach requires the user to accurately identify the size of paper loaded in the cassette body 2 and therefore in the recording system is inconvenient and somewhat complicated. In addition thereto, a separate knob 5 and an adjustable indicator 7 with relatively complicated construction have to be manufactured to reflect the various sizes of paper to be fed into the electrophotographic recording system set by the paper size display penal 8 affixed on the exterior of the front wall 2*a* of the cassette body 2. Such requirements undoubtedly increase overall production costs of the system. If the separate knob 5 is not used however, the paper cassette 1 may be installed in the system, but the user must detach the paper cassette 1 from the recording system and then affirm the size of paper before setting the size of paper loaded in the cassette body 2. If, for any reasons, the size of paper loaded in the cassette body 2 does not correspond to the size of paper set, unexpected errors will occur upon printing.

Figure 2:
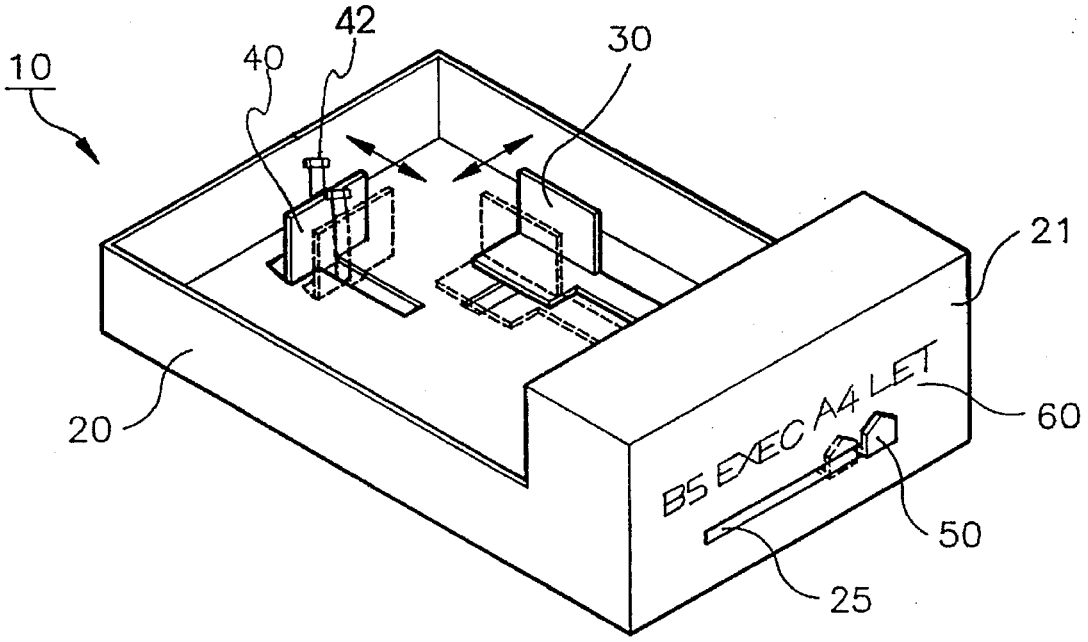
FIG. 2 is a schematic perspective view illustrating a paper cassette according to an embodiment of the present invention.

FIG. 2 is a schematic perspective view illustrating a novel paper cassette 10 according to an embodiment of the present invention. Specifically, the paper cassette 10 includes a cassette body 20 for holding papers of different sizes to be fed into an electrophotographic recording system in a paper feed direction, a first guide member 30 (i.e., width regulation plate) movably installed in the cassette body 20 for regulating placement of papers in a width direction perpendicular to the paper feed direction to accommodate papers of different widths, and a second guide member 40 (i.e., length regulation plate) movably installed in the cassette body 20 for regulating placement of papers in the paper feed direction to accommodate papers of different lengths. Cassette body 20 has a paper size display panel 60 affixed on an exterior of a front wall, and a slit 25 formed on a front wall 21 extending in a width direction perpendicular to the paper feed direction. Paper size display panel 60 comprises a plurality of characters and symbols representing different sizes of paper to provide a visual display of different sizes of papers to be fed into the system. Paper cassette 10 also includes an indicator 50 integrally connected to the first guide member 30 extending through the slit 25 formed on the front wall 21 of the cassette body 20. Indicator 50 is capable of moving along the slit 25 to indicate the various sizes of papers being fed into the system via the paper size display panel 60 when the first guide member 30 moves to accommodate the papers of different sizes. First and second guide members 30 and 40 for guiding the paper into position move in the direction perpendicular to each other so as to firmly hold the paper of different sizes in position for subsequent printing. Additional means such as a screw (not shown) may be used to lock movement of the second guide member 40 so as to firmly hold paper of different lengths in position. For example, a screw 42 as shown in FIG. 2 may be installed along the wall of the second guiding member 40 so that, when the second guiding member 40 moves back and forth along a slit formed in the bottom of the cassette body 20, the screw 42 is used to fix the second guiding member 40 to a desired position in accordance with the length of papers contained the cassette body 20. The plurality of characters and symbols of the paper size display penal 60 representing different sizes of paper such as, for example, A4 size, letter size, legal size and executive size, are affixed on the exterior of the front wall 21 of the cassette body 20 in the region just above the slit 25.

Under such a construction, in order to guide paper of a predetermined size loaded in the cassette body 20 into position, the first and second guide members move towards the direction closely contacted with the paper. At this time, the indicator 50 connected to the first guide member 30 moves in conjunction with the movements of the first and second guide members 30 and 40. As a result, the one end of the indicator 50 protruded through the slit 25 of the cassette body 20 is placed at the paper size display penal 60 displaying the size of paper guided by the first and second guide members 30 and 40. Therefore, the size of paper loaded in the cassette body 20 and to be fed into the electrophotographic recording system can be easily identified, even when the paper cassette 10 is installed in the recording system. Consequently, the user can avoid a problem associated with the conventional paper cassette; that is, to avoid the unnecessary operation of the rotating knob 5 so as to identify the size of paper and reduce production cost, thereby removing any possible malfunctioning of the knob 5 and conveniently providing the user a simply way to identify the size of paper to be fed into the system.

Figure 3:
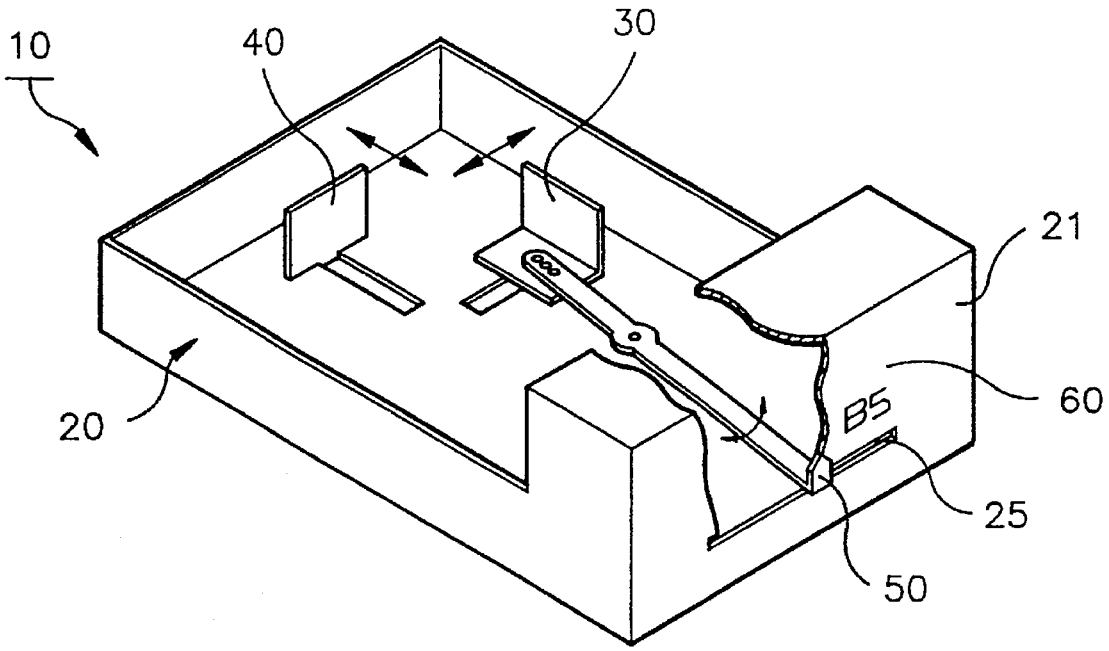
FIG. 3 is a schematic perspective view illustrating a paper cassette according to another embodiment of the present invention.
Figure 4:
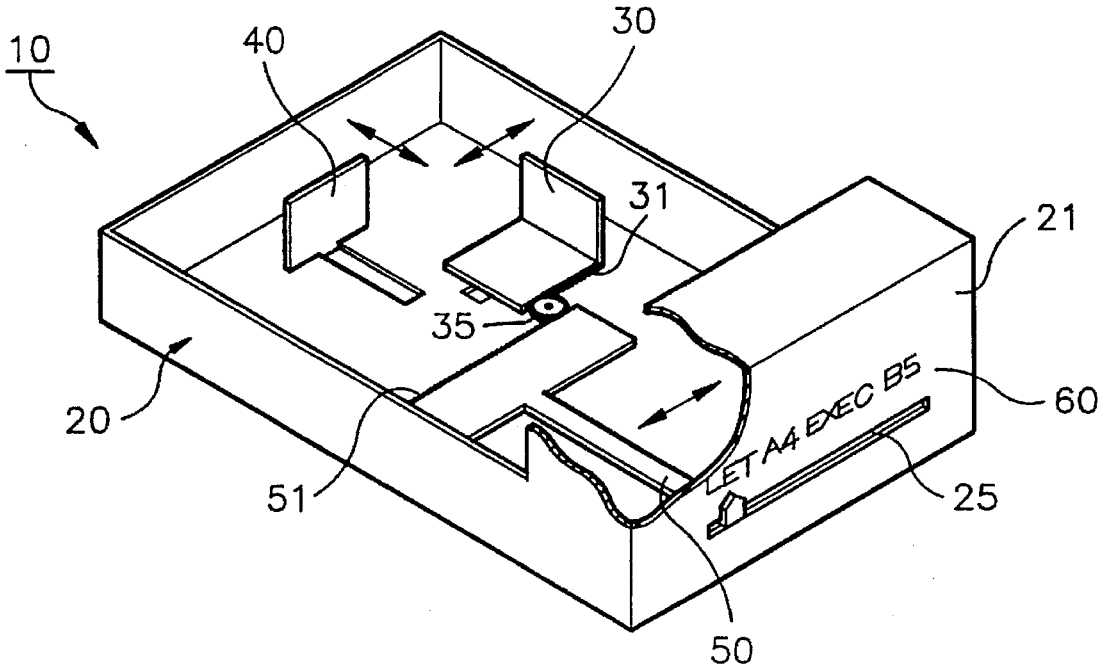
FIG. 4 is a schematic perspective view illustrating a paper cassette according to still another embodiment of the present invention.

FIGS. 3 and 4 illustrate main components of another preferred embodiments of the present invention. Referring to FIG. 3, the paper cassette 10 further includes an indicator 50 integrally extended from the first guide member 30 through the slit 25 formed on the front wall 21 of the cassette body 20 so as to indicate the size of papers being fed into the system via the paper size display panel 60 when the first guide member 30 moves to accommodate the papers of different widths. The indicator 50 according to this embodiment of the invention has one end connected to the first guide member 30, an opposite end extended through the slit 25, and a center portion mounted on a bottom portion of the cassette body 20 so as to enable the indicator 50 and the first guide member 30 to rotate in a reciprocal manner.

Referring now to FIG. 4, the first guide member 30 movably installed in the cassette body 20 comprises a first gear part 31, and the indicator 50 comprises a second gear part 51 enabling the indicator to move in the paper feed direction. A gear member 35 operatively engaged with the first gear part 31 of the first guide member 30 and the second gear part 51 of the indicator 50 so as to enable the indicator 50 to move in the width direction in a reciprocal manner with respect to the first guide member 30. Gear member 35 engaged with the first gear part 31 of the first guide member 30 may be permanently fixed to a bottom surface of the cassette body 20 or remains afloat from the bottom surface of the cassette body and enables the first guide member 30 to move in the width direction to accommodate papers of different widths and concomitantly enables the indicator 50 to move in a reciprocal manner with respect to the first guide member 30 for indicating the size of papers to be fed into the recording system via the paper size display panel 60.

Figure 5:
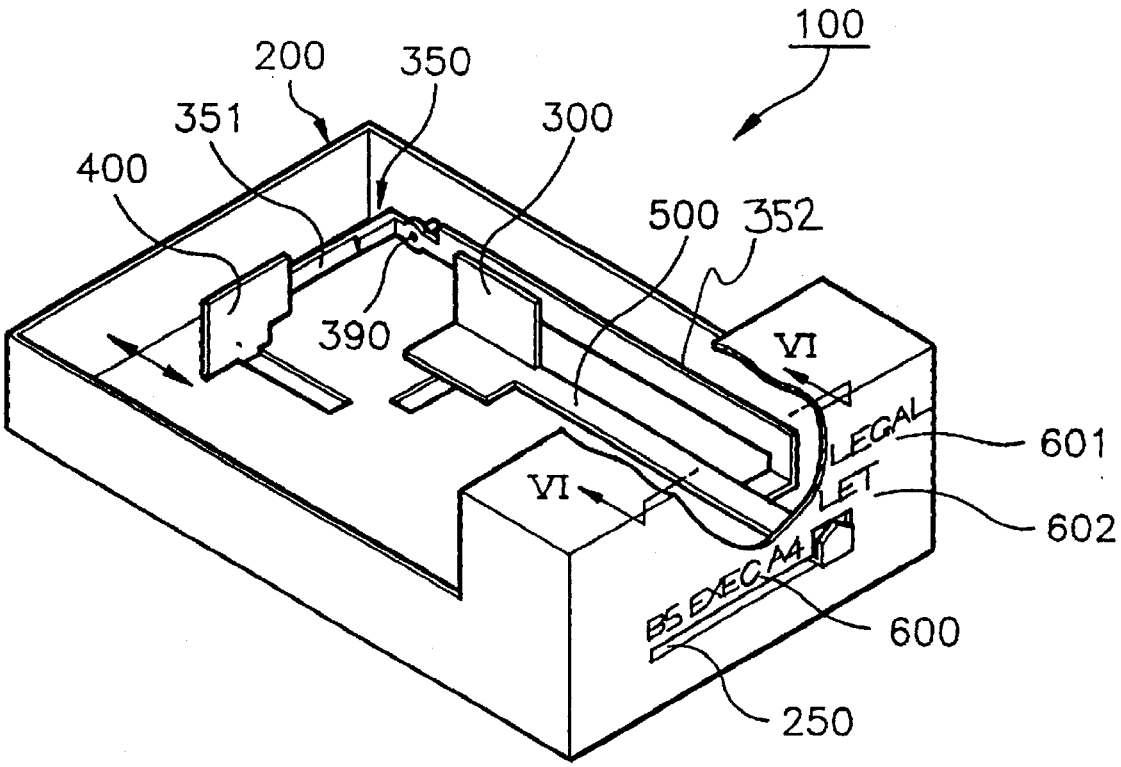
FIG. 5 is a schematic perspective view illustrating a paper cassette according to still yet another embodiment of the present invention with an indicator capable of indicating standard letter size papers (8.5 inches×11 inches) contained in the paper cassette.
Figure 6:
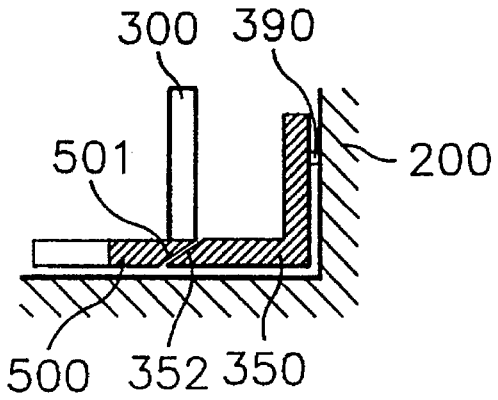
FIG. 6 is a cross-sectional view of the paper cassette of FIG. 5 taken along a line VI—VI shown in FIG. 5.
Figure 7:
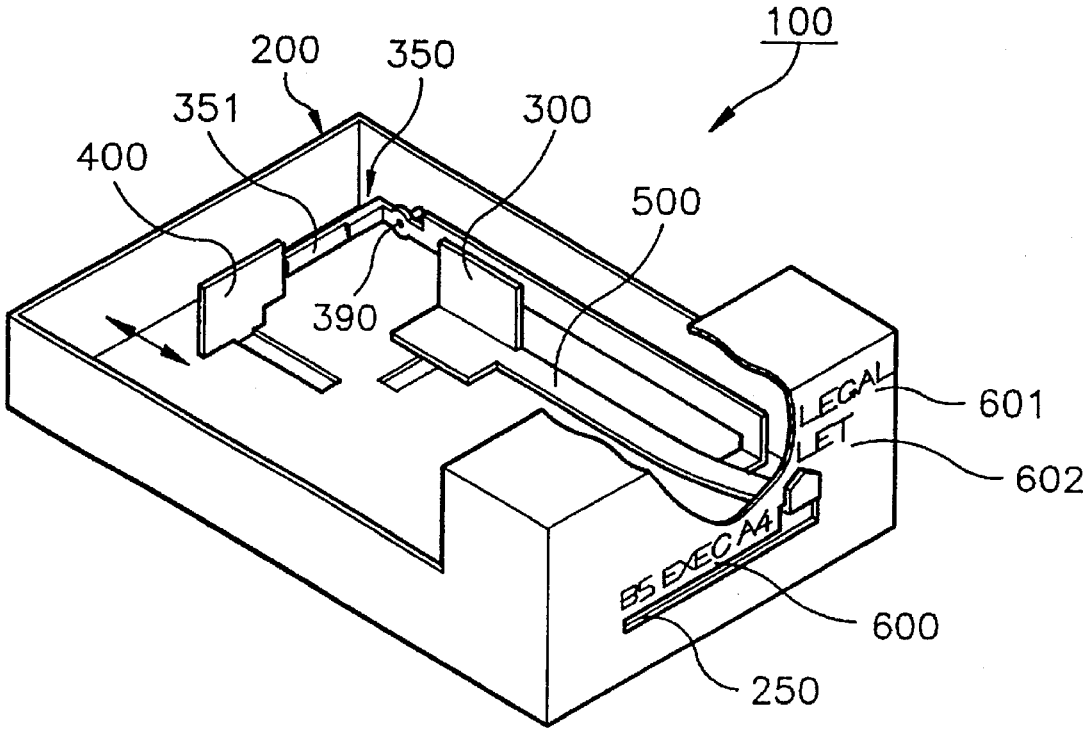
FIG. 7 is a schematic perspective view illustrating a paper cassette of FIG. 5 with the indicator capable of indicating standard legal size papers (8.5 inches×14 inches) contained in the paper cassette.

FIGS. 5 to 7 illustrate yet another embodiments of the present invention, wherein the same reference numerals have the same function as that described in the above. In these drawings, even though any one size of paper may be loaded into the cassette body 20 among papers of different lengths but of the same width, the user can easily identify the size of paper loaded in the cassette body 20 of the paper cassette 10. FIG. 5 is a schematic perspective view illustrating a paper cassette 100 with an indicator 500 integrally connected to first and second guide members 300 and 400 for indicating standard letter size papers (8.5 inches×11 inches) contained in the cassette body 200. FIG. 6 is a cross-sectional view of the paper cassette of FIG. 5 taken along line VI—VI shown in FIG. 5. FIG. 7 is a schematic perspective view illustrating a paper cassette 1000 with an indicator 500 integrally connected to first and second guide members 300 and 400 for indicating standard legal size papers (8.5 inches×14 inches) contained in the cassette body 200 when the indicator 500 moves vertically upward from one end of the slit 250.

In FIGS. 5 to 7, in the same manner as shown in FIG. 2, the paper cassette 100 according to the present invention includes a cassette body 200 for holding paper of different sizes to be fed into an electrophotographic recording system, and a pair of first and second guide members 300 and 400 for regulating placement of paper to accommodate paper of different sizes. A slit 250 is formed on an exterior of the front wall of the cassette body 200 and the other end of an indicator 500 having one end protruded outwardly of the cassette body 200 is fixed to the first guide member 300. A paper size display panel 600 comprising a plurality of size display portions is arranged at the upper portion of the slit 250 so as to respectively identify paper of different lengths but the same width. Top and bottom display portions 601 and 602 indicative of legal size papers and letter size papers are affixed vertically on the exterior of the front wall of the cassette body 200. A lever 350 is combined to a hinge 390 fixed to the side wall of the cassette body 200 to thereby rotate on the plane perpendicular to the bottom portion of the cassette body 200. One end of the lever 350 having a sloping side 351 is placed on the path where the second guide member 400 guides the two different sizes of paper, respectively. The other end of the lever 350 maintains the state contacted to the lower portion of the indicator 500 at the position in which the widths of paper with the different length from each other are guided.

Under such a construction of the paper cassette 100, since the display function for paper of different width has already been explained, further description will be avoided. However, a detailed description of operations of selectively guiding the two sizes of paper of different lengths but with the same width and thereby indicating each of the top and bottom display portions 601 and 602 indicative of either the letter size paper or legal size paper will be described hereinafter.

In case of guiding paper having a relatively small size as shown in FIG. 5, the indicator 500 indicates the bottom display portion 602 in the top and bottom display portions 601 and 602. In this state, if paper having a relatively large size is guided as shown in FIG. 7, the second guide member 400 moves backward in the paper feed direction and suppresses downward the sloping side 351 of the lever 350. Lever 350 then rotates around the hinge 390 in the direction that the end of the lever 350 where the sloping side 351 is formed is downward, thus enabling the other end of the lever 350 to be raised. Indicator 500 being in contact with the other end of the lever 350 is also raised. As a result, the end of the indicator 500 protruded at the front portion of the cassette body 200 is raised to thereby indicate the top display portion 601 among the top and bottom display portions 601 and 602. Under this state, if the second guide member 400 again moves to guide the paper having a relatively small size, the state that the second guide member 400 suppresses the portion where the sloping side 351 of the lever 350 is formed is released to thereby descend the end of the indicator 500, thus maintaining the state shown in FIG. 5. As a result, the end of the indicator 500 protruded at the front portion of the cassette body 200 is raised to thereby indicate the bottom display portion 602 among the top and bottom display portions 601 and 602.

Meanwhile, under the state that the lever 350 is raised by the second guide member 400, after the first guide member 300 is moved to the position where the paper size display panel 600 indicates paper having a relatively small width, if the first guide member 300 is then reverted to the position where the display portion 600 indicates the top and bottom display portions 601 and 602 which display paper having a relatively large width, the lever 350 is caught on the indicator 500, thereby causing an undesirable operation. To prevent such a problem, FIG. 6 shows that it is desirable to provide an upward sloping side 352 at the lever 350 and a downward sloping side 501 at the portion of the indicator 500 corresponding to the upward sloping side 352 such that the indicator 500 can be smoothly raised over the lever 350.

In the embodiment of FIG. 7, the lever 350 is provided in a downward direction of the indicator 500 and the second guide member 400 upwardly presses the sloping side 351 of the lever 350. However, to the contrary, the lever 350 may be provided in an upward direction of the indicator 500, a "legal" indication of the display portions may be made downward, and the second guide member 400 may lift the lower portion of the sloping side 351 of the lever 350.

On the other hand, the indicators 50 and 500 indicate the paper size display portion arranged in the exterior of the cassette body 20 and 200 through the slits 25 and 250. However, it is also possible for the indicators 50 and 500 to indicate the paper size display portion in the lower portion of the paper cassettes 10 and 100. Further, in the attached drawings showing the preferred embodiments of the present invention, the indicators 50 and 500 are adjusted to move horizontally in engagement with the first guide members 30 and 300. It is also possible for the indicators 50 and 500 to move vertically in engagement with the first guide members 30 and 300 and the paper size display portion may be placed along the vertical-moving path of the indicator. At this time, the indicators 50 and 500 can move horizontally at a given position in engagement with the movement of the second guide members 40 and 400. Many widely different embodiments of the present invention, which are capable of easily and correctly identifying the size of paper loaded in the cassette body in response to the movement of the guide members may be constructed without departing from the spirit and scope of the present invention.

As can be apparent from the foregoing, the paper cassette according to the present invention including an indicator for indicating the size of paper in engagement with a guide member serving to guide paper of different sizes loaded in the cassette body to be fed into the electrophotographic recording system, is capable of easily and correctly identifying the size of paper without requiring the user to inconveniently perform a setting operation of the size of paper.

What is claimed is:

1. A paper cassette for holding papers of different sizes to be fed into an image recording system in a paper feeding direction, said paper cassette comprising:

a cassette body for containing paper of different sizes to be fed into the image recording system, said cassette body having a paper size display panel affixed on an exterior of a front wall to provide a visual display of different sizes of paper being fed into the image recording system, a first slit formed on the front wall extending in a width direction perpendicular to said paper feed direction, and a second slit integrally formed on a distal end of said first slit extending vertically from said first slit;

a width regulation plate movably installed in said cassette body, for regulating placement of paper of different widths in said width direction perpendicular to said paper feed direction;

a length regulation plate movably installed in said cassette body, for regulating placement of paper of different lengths in said paper feed direction;

an indicator extended from said width regulation plate through said first slit formed on the front wall of said cassette body, for indicating the size of paper being fed into the image recording system via said paper size display panel when said width regulation plate and said length regulation plate regulate the paper of different widths and lengths, respectively;

a hinge fixed to an interior of a side wall of said cassette body; and a lever coupled to said hinge, connected to said length regulation plate and said indicator, for enabling regulation of paper of different lengths in said paper feed direction, for enabling said indicator to control regulation of said paper of different lengths in said paper feed direction when said indicator extending through said first slit moves vertically in an upward and downward direction through said second slit.

2. The paper cassette of claim 1, further comprised of said paper size display panel comprising said plurality of characters and symbols continuously providing exposed visual representations of different sizes of said paper stored in said cassette body to be fed into said image recording system with each representation of paper size displayed affixed on the exterior of the front wail of said cassette body in different positions spaced apart from each other.

3. The paper cassette of claim 1, further comprised of said lever rotating about said hinge in a reciprocal manner for enabling said length regulation plate to adjust to paper of different lengths in said paper feed direction when said indicator moves vertically in an upward and downward direction through said second slit.

4. The paper cassette of claim 1, further comprised of said indicator moving vertically in an upward and downward direction at one end of said first slit through said second slit to accommodate paper of different lengths.

* * * * *